US006146465A

United States Patent [19]

Xavier et al.

[11] Patent Number: 6,146,465

[45] Date of Patent: Nov. 14, 2000

[54] METHODS FOR CLARIFYING SUGAR SOLUTIONS

[75] Inventors: Carlos Roberto Xavier, Araraquara; Claudio Candido Luiz, Cotia; Luiz Antonio Fernandes, Sao Paulo, all of Brazil

[73] Assignee: Betzdearborn Inc., Trevose, Pa.

[21] Appl. No.: 09/229,797

[22] Filed: Jan. 13, 1999

[51] Int. Cl.[7] ..... C13D 3/16

[52] U.S. Cl. ..... 127/57; 210/705; 210/702; 210/728; 252/175; 252/181

[58] Field of Search ..... 127/48, 57; 210/728, 210/705, 702; 252/175, 181

[56] References Cited

U.S. PATENT DOCUMENTS

| | | |
|---|---|---|
| 3,418,165 | 12/1968 | Rabe . |
| 3,476,597 | 11/1969 | Lippe et al. . |
| 3,808,050 | 4/1974 | Paley . |
| 3,909,287 | 9/1975 | Rundell et al. . |
| 3,926,662 | 12/1975 | Rundell et al. . |
| 3,994,743 | 11/1976 | Paley . |
| 4,039,348 | 8/1977 | Hunwick . |
| 4,081,288 | 3/1978 | Torres . |
| 4,492,601 | 1/1985 | Nakasone et al. . |
| 4,499,112 | 2/1985 | Miller et al. . |
| 4,523,959 | 6/1985 | Exertier . |
| 4,655,934 | 4/1987 | Rose et al. . |
| 4,765,867 | 8/1988 | Dreisbach et al. . |
| 5,110,363 | 5/1992 | Clarke et al. . |
| 5,554,227 | 9/1996 | Kwok et al. . |
| 5,891,254 | 4/1999 | Coville et al. . |

OTHER PUBLICATIONS

CA 1992:492558, Perez Bruffao et al, "Effect of chemical reagents . . . ", 1990.

CA 1987:578508, Zakharov et al, "Clarifying of saturation juice in sugar production", 1987.

1998: 761841 Caplus, Gibson et al., Modified Magnesium Hydroxide Slurry For Use In Treating Wastewater And A Process For Producing Thereof,(1998.) no month provided.

*Primary Examiner*—David Brunsman
*Attorney, Agent, or Firm*—Greenblum & Bernstein, P.L.C.

[57] ABSTRACT

An improved process for clarifying sugar syrup in the flotation system of a sugar making operation. Neutral phosphate-based compounds are added to the flotation system to aid in clarifying the sugar syrup. The use of the neutral phosphate-based compounds will eliminate the use of phosphoric acid and the commensurate need for neutralizing chemical as well as elimination of the tanks for phosphoric acid and neutralizing chemical mixing at field installations.

17 Claims, No Drawings

METHODS FOR CLARIFYING SUGAR SOLUTIONS

FIELD OF THE INVENTION

The present invention relates to an improved process for producing sugar. More particularly, the present invention provides for methods for eliminating the use of phosphoric acid during the pre-coagulation phase of sugar production.

BACKGROUND OF THE INVENTION

After sugar is extracted from prepared cane, the resultant mixed juice (water, sucrose and other impurities) needs to be clarified. In the production of white sugar, this clarification is important as the better the clarification of the sugar juice, the better (i.e., more white) the final sugar will be.

The coagulation of the impurities in the stream is very important in achieving a good end product. After the clarification stage, the evaporation stage takes place. Any impurities present causing color problems in the liquid also get concentrated in the same proportion as the sugar juice does. Color levels of up to 6,000 to 10,000 ICUMSA color units are often obtained in this stage.

As such, a majority of sugar mills will clarify the sugar syrup after the evaporation stage. This process is typically accomplished by pre-coagulating the sugar syrup and passing it through a flotation system.

If phosphoric acid is used as the phosphate source in the pre-coagulation step, lime or calcium sacharate is used to neutralize this and maintain the pH of the sugar syrup in the neutral range to avoid sugar inversion.

This neutralization step can be a complicated operation due to solids level content. Sugar syrup can have 60 to 70% solids content and these can deposit over the pH meter's electrodes reducing its sensitivity and causing pH variations. These variations in pH can cause the color of the clarified syrup to be higher than before the clarification step. This substantially compromises the quality of the final sugar.

Additional complications arise due to the sugar syrup's high concentration. This high concentration causes lime dissolution to be slow and the pH adjustment will take more time to happen. This slow response will cause an overfeed of lime or calcium sacharate which in turn will cause a pH increase to levels other than the correct one and will result in high color and high ash content in the final sugar product.

The present inventors have discovered that these problems can be eliminated by the use of neutral phosphate-based products which will eliminate the syrup neutralization step. Consequently, both the sugar making process is made more efficient and the necessary field intallations for neutralizations will be eliminated.

DETAILED DESCRIPTION OF THE INVENTION

The present invention is an improved process for pre-coagulating sugar syrup during the production of white sugar. The process comprises adding to the sugar syrup during its pre-coagulation in a flotation system an effective clarifying amount of a neutral phosphate-based compound.

The inventive process takes place in a flotation system after evaporation of the sugar syrup. The sugar syrup is passed to the flotation system where the sugar syrup is coagulated or pre-coagulated prior to the syrup being passed to the crystallization phase of the white sugar production process.

After evaporation of the sugar syrup, the syrup becomes more concentrated, as do the relative level of impurities present therein. This syrup is passed along to a flotation device where a coagulant is added. In the process of the present invention, a flocculating polymer is added to the sugar syrup as well as the neutral phosphate source compound. The syrup containing the polymer and neutral phosphate compound is allowed to sit in the flotation device where the impurities in the syrup can be separated from the sugar syrup. The clarified syrup is then passed to the next stage for further evaporation.

For purposes of the present invention, the neutral phosphate-based compound can be a water soluble phosphate-containing compound that will not substantially (i.e., >0.5 pH units) decrease the pH of the sugar syrup.

Representative neutral phosphate compounds include, but are not limited to the halogen salts such as phosphorous trichloride tripolyphosphates, pyrophosphates, hexametaphosphates, and trisodium phosphates. Any phosphate salt that is water soluble and will not substantially decrease the pH of the sugar syrup is expected to be within the purview of this invention. Preferably, the neutral phosphate-based compound is food grade sodium tripolyphosphate such as those commercially available from Monsanto as NUTRIPHOS 088 and Albright and Wilson as ALBRIPHOS 50 F.

The polymer used as the flocculant may be any one of those currently used in the sugar making industry such as anionic polymers. These could include homopolymers or copolymers of at least one of the following anionic monomers: acrylic acid, methacrylic acid, maleic acid or maleic anhydride, fumaric acid or fumaric anhydride, and acrylamido methyl propane sulfonate (AMPS®, available from Lubrizol). The anionic polymers may also contain neutral monomers such as acrylamide, methacrylamide, methacrylate, and ethylacrylate.

For purposes of the present invention, the phrase "effective clarifying amount" is defined as that amount of neutral phosphate-based compound which when added to the flotation system will assist in clarifying the sugar syrup. Preferably, this will range from about 100 parts to about 200 parts per million parts syrup in the flotation system.

Preferably, the neutral phosphate-based compound is added to the sugar syrup prior to its arrival in the flotation system, but may also be added directly to the sugar syrup in the flotation system.

The invention will now be described with reference to a number of specific examples, none of which should be considered as limiting the scope of the invention.

EXAMPLES

Testing was performed to measure lime reduction using neutral phosphate sources in comparison to phosphoric acid. 100 ml of sugar syrup was transferred to a 500 ml beaker. This syrup had a density of 1.085 g/cm$^3$, a brix of 21.5, an original ICUMSA IV number of 9182 and a pH of 5.0.

The temperature of the sucrotest device was first adjusted to 85° C. and mixed strongly for about 1 minute.

The syrup was then transferred to the sucrotest graduated tube while the anionic polymer solution was simultaneously added. The tube was then capped and the agitation and air injection was begun at 65 to 70 rpm for 1 minute.

The size of the formed flakes and flotation velocity was observed. After 20 minutes, a sample was taken and diluted to 10° brix. This sample was filtered through a 47$\mu$ Millipore membrane under vacuum. The absorbance and the transmittance of the filtered sample were measured at 420 nm wave length.

The ICUMSA IV color was calculated using the formula:

$$ICUMSA\ IV\ color = \frac{Absorbance \times 100}{\frac{Brix}{100} \times density \times cuvet\ \ width}$$

where: Density=density of filtered diluted syrup sample

Brix=brix of the filtered diluted syrup sample

Cuvet width=1.0 cm

The results of this testing are presented in Table I. The higher the percent transmittance, the better the clarification of the syrup.

TABLE I

Sucrotest at 85° C., pH of 6.5
0.05% Anionic Polymer Solution Concentration
10.0% Precoagulant Solution Concentration

| Lime/Calcium Sacharate Conc. (mL/L) | Phosphate Source (ppm) | Anionic Polymer (ppm) | ICUMSA IV Color | Transmittance (%) |
|---|---|---|---|---|
| — | — | — | 7,605 | 13.5 |
| 6.0 | A(300) | D(10) | 6,495 | 18.1 |
| — | B(300) | D(10) | 6,573 | 17.7 |
| — | — | — | 22,000 | * |
| 15.6 | A(300) | D(14) | 18,778 | * |
| — | B(300) | D(14) | 15,624 | * |
| — | — | — | 12,818 | 4.88 |
| 3.0 | A(150) | D(9) | 9,027 | 12.0 |
| — | C(250) | D(9) | 8,910 | 12.3 |

Treatment A is $H_3PO_4$
Treatment B is 100% sodium tripolyphosphate (STP)
Treatment C is 20% DMA-EPI copolymer and 10% STP in water
Treatment D is polyacrylamide (?)
* Not measured As demonstrated in Table I the use of the neutral phosphate based compound clarified the sugar syrup as well as the phosphoric acid solution. The use of lime/calcium sacharate is also eliminated reducing the cost of overall chemicals employed.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what we claim is:

1. A process for clarifying sugar syrup during a sugar making operation comprising adding to the syrup an effective clarifying amount of at least one of water soluble tripolyphosphates, pyrophosphates and hexametaphosphates.

2. The process according to claim 1 wherein said syrup is in a flotation system of the sugar making operation.

3. The process according to claim 2 wherein the flotation system immediately follows an evaporation system in the sugar making operation.

4. The process according to claim 1 wherein the at least one of water soluble tripolyphosphates, pyrophosphates and hexametaphosphates comprises at least one water soluble tripolyphosphate.

5. The process according to claim 4 wherein the at least one water soluble tripolyphosphate comprises sodium tripolyphosphate.

6. The process according to claim 5 wherein the at least one of water soluble tripolyphosphates, pyrophosphates and hexametaphosphates is added to the syrup in an amount ranging from about 100 parts to about 200 parts per million parts of the syrup.

7. The process according to claim 1 wherein the at least one of water soluble tripolyphosphates, pyrophosphates and hexametaphosphates comprises at least one water soluble pyrophosphate.

8. The process according to claim 1 wherein the at least one of water soluble tripolyphosphates, pyrophosphates and hexametaphosphates comprises at least one water soluble hexametaphosphate.

9. The process according to claim 1 further comprising adding an anionic polymer to the syrup.

10. The process according to claim 9 wherein the anionic polymer comprises homopolymers and copolymers of at least one of anionic monomers of at least one of acrylic acid, methacrylic acid, maleic acid or maleic anhydride, fumaric acid or furmaric anhydride, and acrylamido methyl propane sulfonate.

11. The process according to claim 9 wherein the anionic polymer is added subsequent to addition of the at least one of water soluble tripolyphosphates, pyrophosphates and hexametaphosphates.

12. The process according to claim 11 wherein the anionic polymer comprises homopolymers and copolymers of at least one of anionic monomers of at least one of acrylic acid, methacrylic acid, maleic acid or maleic anhydride, fumaric acid or fumaric anhydride, and acrylamido methyl propane sulfonate.

13. The process according to claim 1 wherein the at least one of water soluble tripolyphosphates, pyrophosphates and hexametaphosphates is added to the syrup in an amount ranging from about 100 parts to about 200 parts per million parts of the syrup.

14. A process for clarifying sugar syrup during a sugar making operation comprising adding to the syrup in a flotation system of the sugar making operation an effective clarifying amount of at least one water soluble compound that will not substantially decrease the pH of the syrup, the at least one water soluble compound comprising at least one of tripolyphosphates, pyrophosphates and hexametaphosphates, and adding at least one anionic polymer to the syrup subsequent to addition of the at least one water soluble compound.

15. The process according to claim 14 wherein the at least one of water soluble tripolyphosphates, pyrophosphates and hexametaphosphates is added to the syrup in an amount ranging from about 100 parts to about 200 parts per million parts of the syrup.

16. The process according to claim 14 wherein the at least one of water soluble tripolyphosphates, pyrophosphates and hexametaphosphates comprises at least one water soluble tripolyphosphate.

17. The process according to claim 16 wherein the at least one water soluble tripolyphosphate comprises sodium tripolyphosphate.

* * * * *